US008350652B2

(12) United States Patent
Hoppe et al.

(10) Patent No.: US 8,350,652 B2
(45) Date of Patent: Jan. 8, 2013

(54) ELECTROMAGNETIC ACTUATING UNIT FOR A HYDRAULIC DIRECTIONAL CONTROL VALVE AND METHOD FOR THE ASSEMBLY THEREOF

(75) Inventors: Jens Hoppe, Erlangen (DE); Stefan Konias, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/130,612

(22) PCT Filed: Oct. 19, 2009

(86) PCT No.: PCT/EP2009/063646

§ 371 (c)(1),
(2), (4) Date: May 23, 2011

(87) PCT Pub. No.: WO2010/060690

PCT Pub. Date: Jun. 3, 2010

(65) Prior Publication Data

US 2011/0220826 A1 Sep. 15, 2011

(30) Foreign Application Priority Data

Nov. 26, 2008 (DE) ..... 10 2008 059 012

(51) Int. Cl.
*H01F 3/00* (2006.01)

(52) U.S. Cl. ..... 335/262; 335/255; 335/261; 335/270; 335/273; 335/278; 335/279; 335/281; 335/297; 310/12

(58) Field of Classification Search ..... 335/220, 335/236, 253, 255, 258, 261, 262, 270, 273, 335/274, 278, 279, 281, 282, 296, 297, 299; 310/12, 15, 17, 23, 24
See application file for complete search history.

(56) References Cited

U.S. PATENT DOCUMENTS

| | | | | |
|---|---|---|---|---|
| 2,407,963 | A * | 9/1946 | Persons | 335/261 |
| 4,493,474 | A | 1/1985 | Ohyama | |
| 5,856,771 | A | 1/1999 | Nippert | |
| 6,213,447 | B1 * | 4/2001 | Bircann et al. | 251/86 |
| 6,615,780 | B1 * | 9/2003 | Lin et al. | 123/90.17 |
| 6,918,571 | B1 | 7/2005 | Rose | |
| 7,209,020 | B2 * | 4/2007 | Telep | 335/255 |
| 8,020,675 | B2 * | 9/2011 | Cao et al. | 188/157 |

(Continued)

FOREIGN PATENT DOCUMENTS

| | | | |
|---|---|---|---|
| DE | 197 16 517 | A1 | 10/1998 |
| DE | 101 53 019 | A1 | 5/2003 |
| DE | 102 11 467 | A1 | 9/2003 |
| DE | 103 00 974 | A1 | 7/2004 |
| DE | 10 2004 057 873 | A1 | 6/2005 |

(Continued)

*Primary Examiner* — Mohamad Musleh
(74) *Attorney, Agent, or Firm* — Lucas & Mercanti, LLP; Klaus P. Stoffel

(57) ABSTRACT

An electromagnetic actuating unit for a hydraulic directional control valve and a method for the assembly thereof. The actuating unit has a coil for generating a magnetic field, a yoke unit with a yoke and a yoke plate, and a pole core unit with a pole core and a housing for conducting a magnetic flux, and an armature unit which is arranged in the magnetic field of the coil and has an armature and a pressure pin as an actuator. The armature unit can be displaced in the direction of the longitudinal axis thereof in a first bearing point in the yoke unit and in a second bearing point in the pole core unit. At least one of the hearing points can be displaced in the radial direction during assembly of the actuating unit and can be fixed after a coaxial orientation of both bearing points.

11 Claims, 4 Drawing Sheets

U.S. PATENT DOCUMENTS

| | | | | |
|---|---|---|---|---|
| 2002/0104977 | A1* | 8/2002 | Bircann et al. | 251/129.15 |
| 2004/0257185 | A1* | 12/2004 | Telep | 335/220 |
| 2005/0024174 | A1* | 2/2005 | Kolb et al. | 335/220 |
| 2005/0133099 | A1* | 6/2005 | Ino et al. | 137/625.65 |
| 2005/0218363 | A1 | 10/2005 | Furuta et al. | |
| 2008/0217121 | A1* | 9/2008 | Cao et al. | 188/157 |
| 2009/0039992 | A1* | 2/2009 | Ryuen et al. | 335/255 |
| 2011/0285484 | A1* | 11/2011 | Hoppe et al. | 335/229 |

FOREIGN PATENT DOCUMENTS

| | | | |
|---|---|---|---|
| DE | 10 2005 048 732 | A1 | 4/2007 |
| DE | 10 2005 049663 | A1 | 4/2007 |
| DE | 10 2006 042215 | A1 | 3/2008 |
| EP | 1 255 067 | A1 | 11/2002 |
| EP | 1 357 339 | A2 | 10/2003 |
| JP | 2005 188630 | A | 7/2005 |

* cited by examiner

ELECTROMAGNETIC ACTUATING UNIT FOR A HYDRAULIC DIRECTIONAL CONTROL VALVE AND METHOD FOR THE ASSEMBLY THEREOF

This application is a 371 of PCT/EP2009/063646 filed Oct. 19, 2009, which in turn claims the priority of DE 10 2008 059 012.6 filed Nov. 26, 2008, the priority of both applications is hereby claimed and both applications are incorporated by reference herein.

FIELD OF THE INVENTION

The invention relates to an electromagnetic actuating unit for a hydraulic directional control valve and to a method for the assembly thereof.

Such directional control valves are used for example in internal combustion engines for the actuation of hydraulic camshaft adjusters.

BACKGROUND OF THE INVENTION

DE 103 00 974 A1 discloses a proportional solenoid valve of a camshaft adjuster device for motor vehicles. The proportional solenoid valve has a valve housing in which a piston is slidable and which has a plurality of ports via which hydraulic oil can be supplied. The proportional solenoid valve also comprises an electromagnet part by means of which the piston can be adjusted via a plunger. The plunger is mounted in an axial bore in a housing of the electromagnet part, whereby it can slide axially.

DE 102 11 467 A1 presents a camshaft adjuster having an electromagnet which is designed as a repelling proportional magnet. The proportional magnet has a magnet armature which is fixedly seated on an armature plunger guided through a pole core and which bears with a free end surface against a control piston or against a part fixedly connected thereto.

DE 101 53 019 A1 presents an electromagnet which is suitable in particular as a proportional magnet for actuating a hydraulic valve. The electromagnet comprises a hollow cylindrical coil body which is delimited by an upper pole shoe and a lower pole shoe. The electromagnet is surrounded by a magnet housing. The coil body acts magnetically on a magnet armature which transmits the magnetic force onward via a plunger rod for actuating the hydraulic valve. The plunger rod is mounted in an axial bore in the lower pole shoe, whereby it can slide axially.

DE 10 2004 057 873 A1 relates to a seat valve having a line system for conducting through an inflowing medium. The seat valve has a seat and an adjustable closing element in the line system. The adjustable closing element is actuated by means of an electromagnetic actuating device. The electromagnetic actuating device comprises an armature housing in which an armature is arranged so as to be adjustable in the direction of a coil axis. The armature is connected to an actuating element which actuates the closing element. The actuating element is mounted in an axial bore in the housing of the electromagnetic actuating device, whereby it can slide axially.

DE 10 2005 048 732 A1 relates to an electromagnetic actuating unit of a hydraulic directional control valve. The electromagnetic actuating unit comprises an armature, which is arranged in an axially slidable manner within an armature chamber, and a pole core, which is arranged in a receptacle and delimits the armature chamber in one movement direction of the armature. Furthermore, the electromagnetic actuating unit comprises a coil which is preferably encapsulated with a non-magnetizable material so as to form a coil body. The armature is mounted in a sliding sleeve, whereby it can slide axially with low friction.

JP 2005-188630 A presents a hydraulic directional control valve having an electromagnetic actuating unit. The electromagnetic actuating unit comprises a coil for generating a magnetic field which acts on an axially slidable armature. The armature comprises an actuating element which actuates the hydraulic directional control valve. The actuating element is mounted in an axial bore in the housing of the electromagnetic actuating device, whereby it can slide axially.

FIG. 1 shows a further electromagnetic actuating unit according to the prior art in a longitudinal sectional illustration. Said electromagnetic actuating unit is designed for actuating a hydraulic directional control valve which is designed as a central valve and which is arranged radially within an inner rotor of a device for variably adjusting the control times of an internal combustion engine. The electromagnetic actuating unit comprises firstly a coil 01 which is fed electrically via a plug contact 02. The coil 01 is arranged within a coil body 03 which is produced by the encapsulation of the coil 01 with a plastic. The magnetic field that can be generated by means of the coil 01 is transmitted via a soft iron circuit, composed of a yoke 04, a yoke plate 06, a pole core 07 and a housing 08, to an axially movably mounted magnet armature 09. The magnetic field exerts a magnetic force on the magnet armature 09 via an air gap between the pole core 07 and the magnet armature 09. Said magnetic force is transmitted via a pressure pin 11 of the magnet armature 09 to a piston of the central valve (not shown). The electromagnetic actuating unit is fastened by means of a flange 12 of the housing 08 to the central valve or to a housing surrounding the central valve. The magnetic field that can be generated by means of the coil 01 does not act entirely in the sliding direction of the magnet armature 09 on account of an eccentricity of the magnet armature 09. Said eccentricity is caused firstly by a degree of play of the magnet armature 09 and of the pressure pin 11 in the bearing arrangement thereof. Secondly, the eccentricity is a result of a deviation of the coaxiality between an armature bearing 13 and a pole core bearing 14. Said deviation may be extremely large depending on the assembly concept and on the tolerances of the components of the electromagnetic actuating unit. On account of the eccentricity of the magnet armature 09, parts of the magnetic field that can be generated by means of the coil 01 act laterally on the magnet armature 09, as a result of which forces are generated which act laterally on the magnet armature 09. Said laterally acting forces are proportional to the eccentricity of the magnet armature 09 or even proportional to the square of the eccentricity of the magnet armature 09. The alignment errors resulting from the deviation of the coaxiality between the armature bearing 13 and the pole core bearing 14 lead to tilting of the magnet armature 09 in its armature hearing 13. As a result of said tilting, the pressure pin 11 no longer slides on the entire bearing surface of the pole core bearing 14; in particular, a situation may arise in which the pressure pin 11 is mounted only on the edges of the pole core bearing 14. This leads to restricted functionality of the electromagnetic actuating unit and to increased wear of the pressure pin 11 and of the pole core bearing 14. Furthermore, the increased wear leads to an increasing eccentricity of the magnet armature 09, as a result of which the forces acting laterally on the magnet armature 09 increase yet further. As a result, the wear exhibits a progressive profile. The final result is failure of the device for variably adjusting the control times of the internal combustion engine, in particular on account of the fact that the adjustment of the control times of the internal combustion engine can no longer take place within the admissible adjustment times.

It is the object of the present invention, taking the electromagnetic actuating unit shown in FIG. 1 as a starting point, to provide an improved electromagnetic actuating unit which can firstly be produced particularly cost-effectively on account of larger possible tolerances of the individual components, and secondly has a long service life as a result of good concentricity of the bearing points.

SUMMARY OF THE INVENTION

The object is achieved by means of an electromagnetic actuating unit of the present invention and by means of a method for the assembly thereof.

The electromagnetic actuating unit according to the invention serves for the adjustment of a hydraulic directional control valve, for example for variably adjusting the control times of an internal combustion engine. The electromagnetic actuating unit initially comprises, as is known, a coil by means of which a magnetic field can be generated. The actuating unit also comprises an armature unit having an armature and a pressure pin. The pressure pin forms an actuator of the electromagnetic actuating unit. By means of the pressure pin, the hydraulic directional control valve can be acted on so as to be adjusted. For this purpose, the armature unit is mounted, so as to be slidable along its axis, in two bearing points.

Said axis is conventionally formed by an axis of symmetry of the armature unit, which in a typical ideal design of electromagnetic actuating units is identical to the axis of symmetry of the armature and/or the coil. To slide the pressure pin axially, the armature acts on the pressure pin, which predefines the axial sliding movement. The armature and the pressure pin perform the axial sliding movement jointly. The armature is situated in the magnetic field of the coil, as a result of which said armature is acted on by a magnetic force which causes the sliding movement. The pressure pin follows the axial sliding movement of the armature on account of the fixed connection thereto.

The armature unit is mounted in two bearing points. Here, a first bearing point is provided in a yoke unit in which the armature is mounted so as to be axially slidable. A second bearing point provided in a pole core unit serves as a bearing arrangement for the pressure pin fixedly connected to the armature. The pressure pin is guided through said second bearing point. The hearing arrangement permits an axial sliding movement of the pressure pin, that is to say a movement in the direction of its longitudinal axis.

In another embodiment, the pressure pin is mounted in both bearing points and is guided through and fixed in a central bore of the armature, such that the armature is fixedly mounted on the pressure pin. The method according to the invention can be applied particularly advantageously in said embodiment because the pressure pin itself forms the longitudinal axis of the armature unit and at least the armature, as a tolerance-afflicted part, does not form a part of the bearing arrangement.

According to the invention, at least one of the two bearing points is in a radially free, that is to say "floating," state during assembly. During assembly, the two bearing points are coaxially aligned with one another and the free bearing point is subsequently fixed. The fixing may take place for example by means of adhesive bonding, soldering, welding, stamping, crimping or clamping.

In a preferred embodiment of the invention, the alignment of the hearing points is realized by means of a centering sleeve which is inserted as a centering aid into the coil and in which the bearing points are aligned coaxially with the longitudinal axis of the armature unit. It is however likewise possible to realize the alignment of the bearing points by means of an assembly device which performs the alignment.

The coil is preferably arranged within a coil body and has a hollow cylindrical basic shape. The armature, a yoke unit with a yoke and cover, and a pole core unit with a pole core and a magnet housing are preferably arranged in the cavity of the hollow cylindrical basic shape of the coil body. Efficient functioning, a compact design and cost-effective assembly of the electromagnetic actuating unit are ensured in this way. Here, the armature, the yoke and the pole core are of rotationally symmetrical design, wherein the axes of rotation of the hollow cylindrical basic shape of the coil body, of the armature, of the yoke and of the pole core coincide. Said axes of rotation form the axis of the electromagnetic actuating unit, in which the armature moves with the pressure pin in a translatory fashion.

The coil body is preferably held, with its lateral surface and a base surface, in a positively locking manner by the housing. Secure assembly of the coil body relative to the hydraulic directional control valve is ensured in this way, such that large forces for adjusting the hydraulic directional control valve can be transmitted.

The electromagnetic actuating unit according to the invention is particularly suitable for the actuation of a hydraulic directional control valve designed as a central valve. The central valve is arranged radially within an inner rotor of a device for variably adjusting the control times of an internal combustion engine. Such actuating units are also referred to as a central magnet. The electromagnetic actuating unit according to the invention is however also suitable for adjusting other hydraulic directional control valves, for example also in applications other than internal combustion engines.

Further advantages, details and refinements of the present invention will emerge from the following description of preferred embodiments, with reference to the drawing, in which:

DETAILED DESCRIPTION OF THE INVENTION

Figure 1:
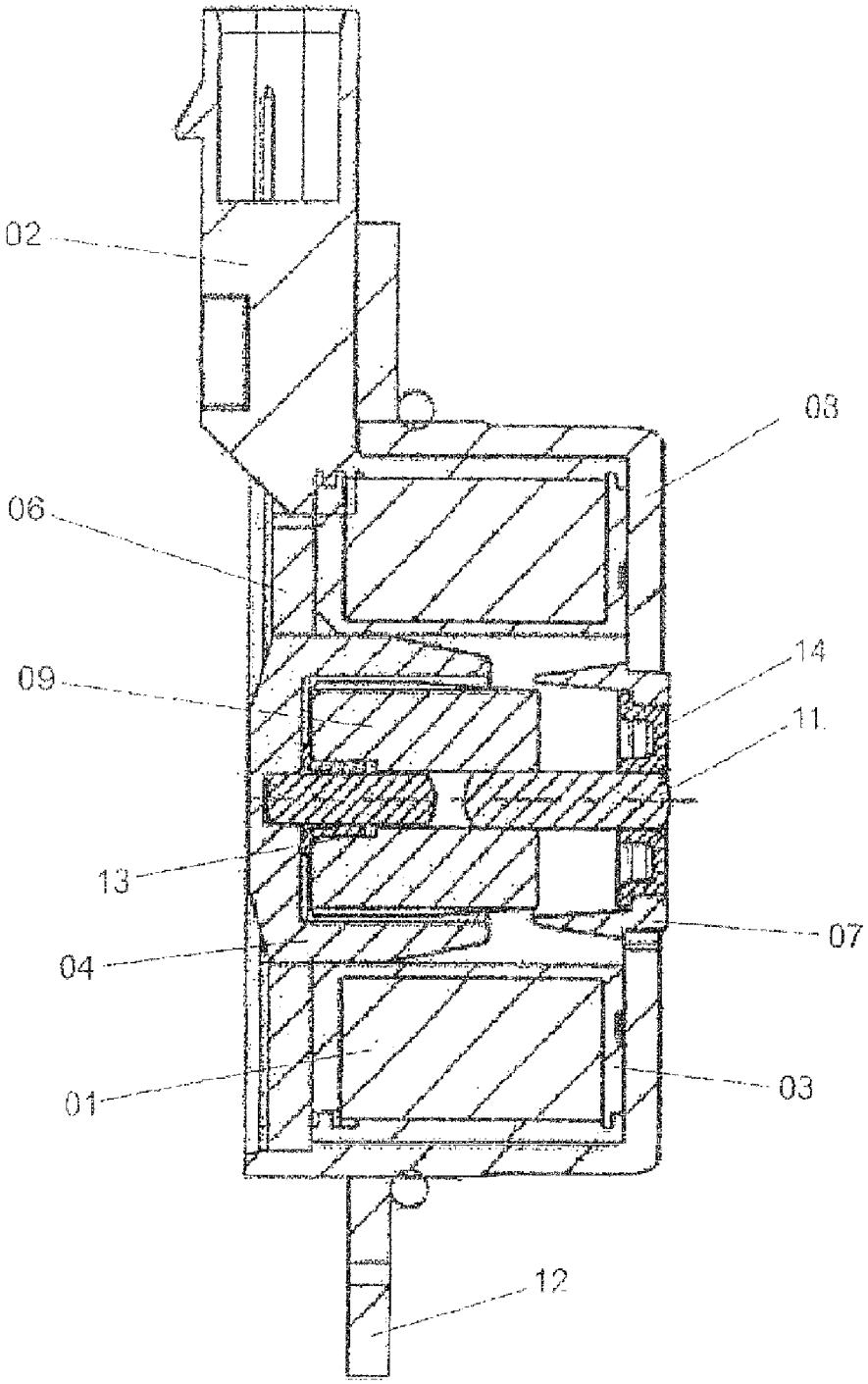
Fig. 1 Prior Art
FIG. 1 shows an electromagnetic actuating unit for a hydraulic directional control valve according to the prior art.

FIG. 1 shows an electromagnetic actuating unit for a hydraulic directional control valve for variably adjusting the control times of an internal combustion engine, such as is known from the prior art and has already been explained in the introductory part of the description.

The plurality of embodiments of the electromagnetic actuating unit according to the invention which will be described in FIGS. 2 to 11 initially have (like the actuating unit according to the prior art shown in FIG. 1) a coil 01, a plug contact 02, a coil body 03, a yoke 04, a yoke plate 06, a pole core 07, a housing 08, a magnet armature 09 and a pressure pin 11. The functional relationship between the stated components is the same as the functional relationship between the components of the electromagnetic actuating unit according to the prior art shown in FIG. 1.

The armature 09 and pressure pin 11 form an armature unit. The armature unit may also be formed in one piece in modified embodiments. The yoke 04 and the yoke plate 06 form a yoke unit which is preferably preassembled. The pole core 07 and the housing 08 form a pole core unit.

In all of the following figures, the structural difference in relation to the embodiment according to the prior art illustrated in FIG. 1 is that the armature 09 has a central bore 18 through which the pressure pin 11 is guided and axially fixed. The pressure pin 11 is mounted in a first bearing point 16, which is situated in the yoke 04, and in a second bearing point 17, which is provided in the pole core 07. Provided within the coil 08 is a centering sleeve 19 which, during assembly, serves to center the yoke unit and pole core unit, and therefore to coaxially align the bearing points 16, 17.

Figure 2:
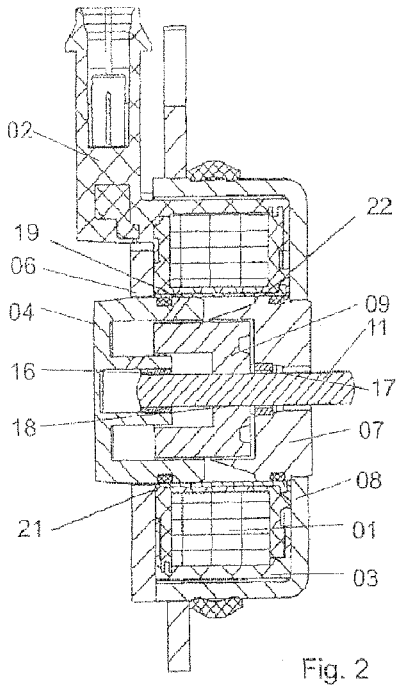
FIG. 2 shows a first embodiment of the invention with pressed-in components.

In the embodiment illustrated in FIG. 2, the yoke unit with the yoke 04 and yoke plate 06 and also the pole core unit with the pole core 07 and housing 08 are assembled so as to be mounted in a floating fashion, and during assembly are aligned by means of the centering sleeve 19 and are axially fixed by virtue of the yoke unit and pole core unit being pressed into the centering sleeve. The yoke unit is fixed by means of an interference fit at a fixing point 21, and the pole core unit is fixed by means of an interference fit at a fixing point 22.

Figure 3:
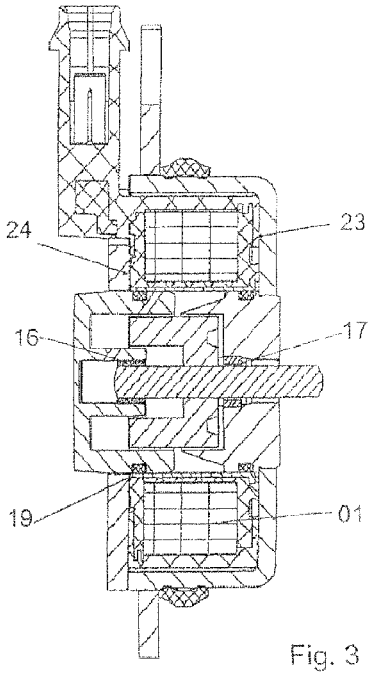
FIG. 3 shows a second embodiment of the invention with two adhesive bond points.

FIG. 3 shows a second preferred embodiment of the invention. The coaxial alignment of the bearing points 16, 17 is provided again by means of the centering sleeve 19. Fixing is subsequently carried out by virtue of the coil 01 being adhesively bonded into the pole core unit at an adhesive bond point 23 and by virtue of the yoke unit being adhesively bonded to the core 01 at an adhesive bond point 24.

Figure 4:
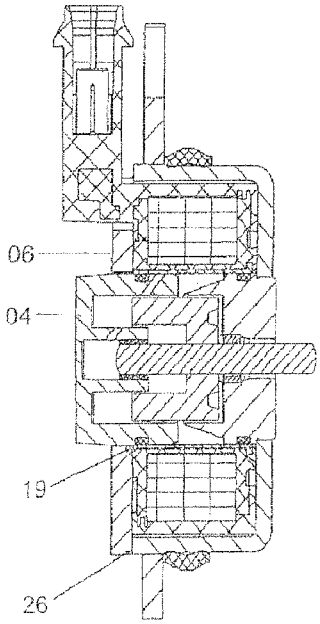
FIG. 4 shows a third embodiment of the invention with adhesively bonded components.
Figure 5:
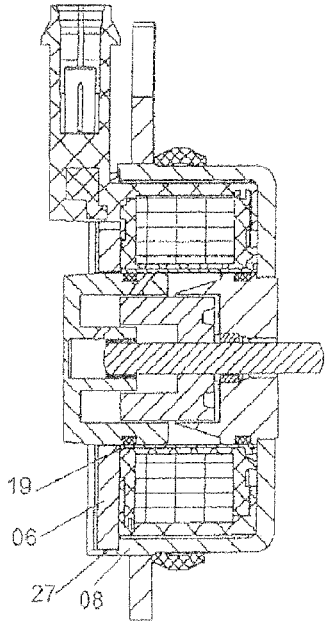
FIG. 5 shows a fourth embodiment of the invention with an adhesive bond point between the yoke unit and pole core unit.

In the embodiment illustrated in FIG. 4, the yoke unit with the yoke 04 and yoke plate 06 is assembled so as to be mounted in a floating fashion. The hearing points 16, 17 are fixed by virtue of the yoke unit being adhesively bonded to the pole core unit at an adhesive bond point 26. In a modified embodiment, the adhesive bond point between the yoke unit and pole core unit could also be situated within the housing 08 by virtue of the yoke plate 06 being adhesively bonded with its end side into an edge projection 27 of the housing (FIG. 5).

Figure 6:
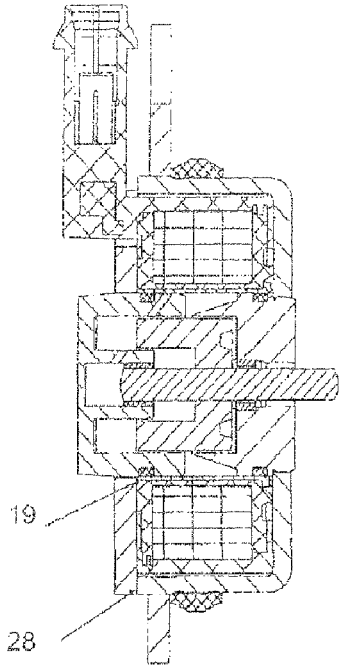
FIG. 6 shows a fifth embodiment of the invention with a solder point between the yoke unit and pole core unit.

In the embodiment illustrated in FIG. 6, in contrast to the design described in FIG. 4, the fixing point is a solder point 28.

Figure 7:
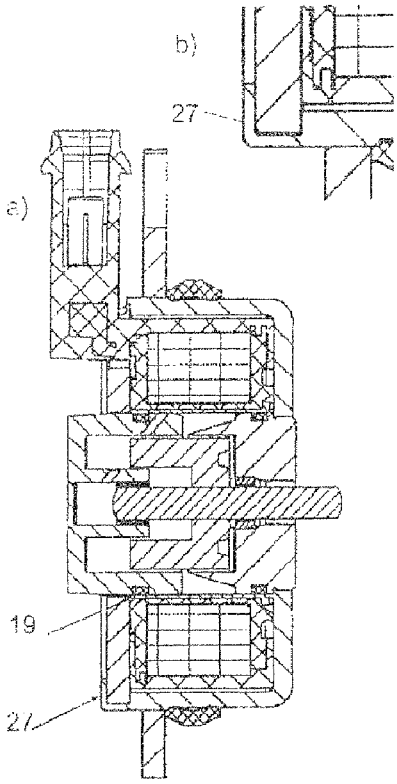
FIG. 7 shows two images of a sixth embodiment of the invention with a crimp point between the yoke unit and pole core unit.

In the illustration of FIG. 7, the fixing of the pole core unit and of the yoke unit is realized by means of lateral-force-free round crimping of the edge projection 27 over the yoke unit. Figure b) shows the detail of the fixing point.

Figure 8:
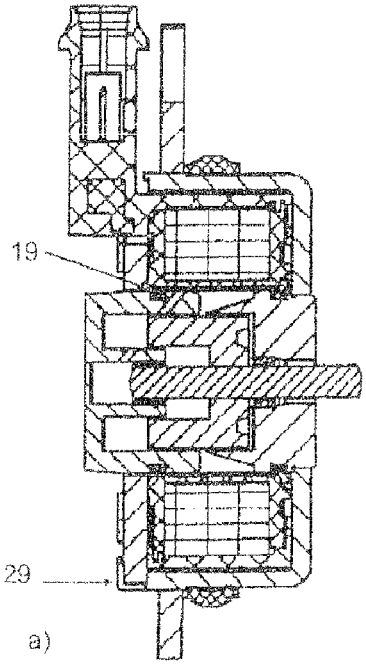
FIG. 8 shows two images of a seventh embodiment of the invention with retaining lugs.
Figure 8:
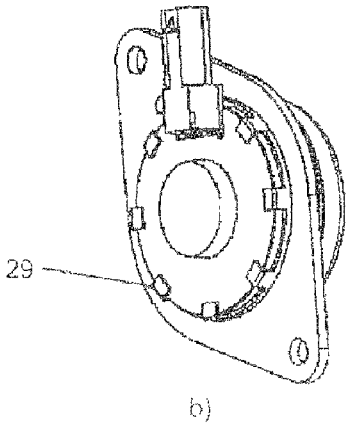

Another preferred embodiment is shown in FIG. 8, in which retaining lugs 29 are formed on the edge projection 27. In said embodiment, fixing of the pole core unit and of the yoke unit is realized by means of lateral-force-free folding of the retaining lugs 29 over the yoke unit. Figure b) shows the actuating unit in a three-dimensional view.

Figure 9:
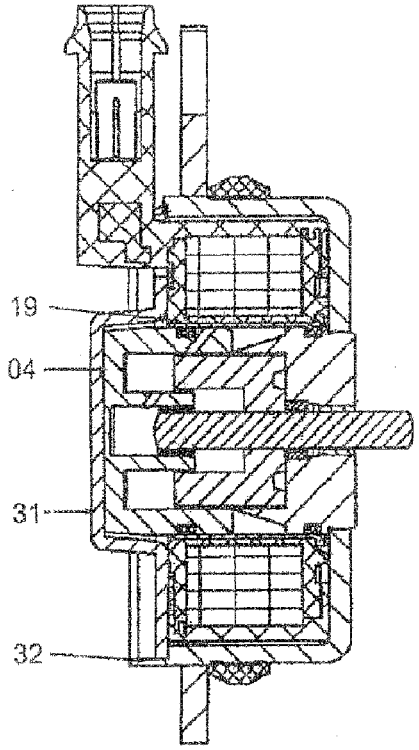
FIG. 9 shows an eighth embodiment of the invention with pressed-in components.

In the embodiment illustrated in FIG. 9, during assembly, the yoke 04 is mounted in a floating fashion and is aligned by means of the centering sleeve 19. The axial fixing is subsequently realized by means of a yoke plate designed as a cover 31. The cover 31 spans the entire yoke 04 and is connected to the housing 08 by calking at a fixing point 32.

Figure 10:
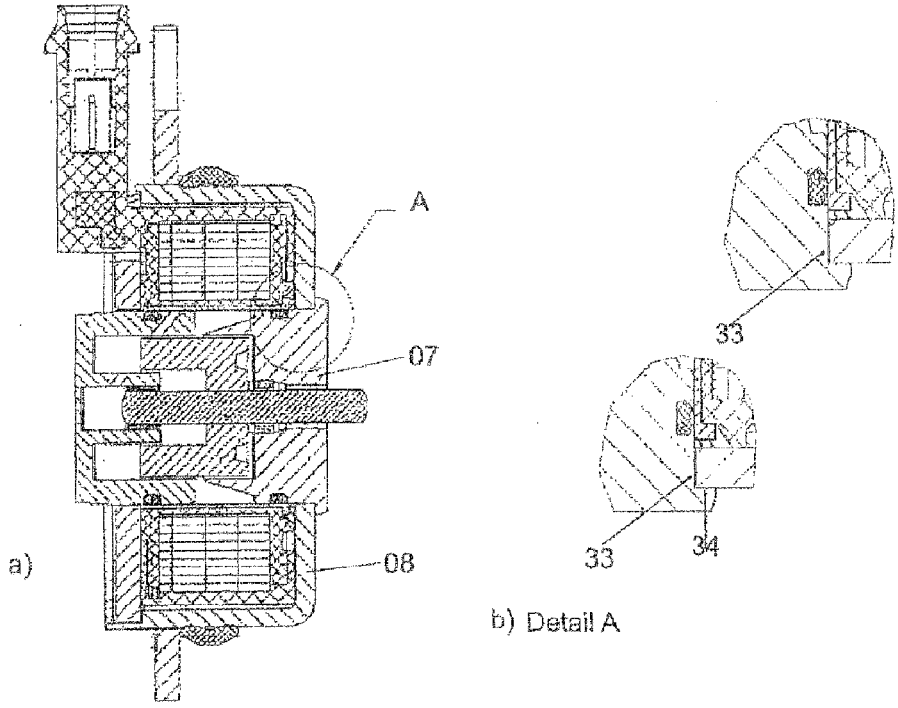
FIG. 10 shows two images of a ninth embodiment of the invention with an adhesive bond point between the pole core and housing.

A further assembly option is for the pole core 07 to be mounted in a floating fashion during assembly, as shown in FIG. 10. Figure b) shows the detail of the fixing point. In said embodiments, the yoke unit is connected to the housing 08, for example by calking. The pole core 07 is mounted in a floating fashion at a clearance fit 33, and after the alignment, is either adhesively bonded at the clearance fit 33 or is adhesively bonded or soldered at a fixing point 34.

LIST OF REFERENCE NUMERALS

01 Coil
02 Plug Contact
03 Coil Body
04 Yoke
05 -
06 Yoke Plate
07 Pole Core
08 Housing
09 Magnet Armature
10 -
11 Pressure Pin
12 Flange
13 Armature Bearing
14 Pole Core Bearing
15 -
16 Bearing Point, First
17 Bearing Point, Second
18 Central Bore
19 Centering Sleeve
20 -
21 Fixing Point
22 Fixing Point
23 Adhesive Bond Point
24 Adhesive Bond Point
25 -
26 Adhesive Bond Point
27 Edge Projection
28 Solder Point
29 Retaining Lug
30 -
31 Cover
32 Fixing Point
33 Clearance Fit
34 Fixing Point

The invention claimed is:

1. An electromagnetic actuating unit for a hydraulic directional control valve, comprising:

a housing for conducting a magnetic flux;

a coil for generating a magnetic field in the housing;

a yoke unit having a yoke in the coil, a yoke plate axially adjacent the coil and a first bearing point;

a pole core unit having a pole core in the coil and a second bearing point;

an armature unit arranged in the coil having an armature and a pressure pin acting as an actuator, the armature unit is mounted, so as to be slidable in a direction of a longitudinal axis, in the first bearing point and in the second bearing point;

wherein, in a first assembly state of the actuating unit, at least one of the first bearing point or the second bearing point is radially movable and, in a second assembly state, after a coaxial alignment of the first bearing point and the second bearing point, at least one of the first bearing point and the second bearing point is fixed; and a centering sleeve arranged in the coil, the centering sleeve servers for a radial alignment of the first bearing point and the second bearing point during assembly.

2. The actuating unit as claimed in claim 1, wherein the centering sleeve receives the yoke unit and the pole core unit during assembly and serves for an axial and/or a radial positioning of the first bearing point and the second bearing point by axial and/or radial positioning of the yoke unit and the pole core unit.

3. The actuating unit as claimed in claim 1, wherein the pressure pin is mounted at each end in one of the first bearing point and the second bearing point, and the armature has a central bore through which the pressure pin is guided and axially fixed.

4. The actuating unit as claimed in claim 1, wherein a fixing point is provided between the yoke plate and the housing.

5. The actuating unit as claimed in claim 4, wherein the fixing point is formed by an adhesive bond point, a solder point, a weld seam, a crimped connection or by folded-over retaining lugs.

6. The actuating unit as claimed in claim 1, wherein a clearance fit and a fixing point are provided between the pole core and the housing, the fixing point is formed by an adhesive bond point in a clearance fit or a solder point or a weld seam.

7. A method for the assembly of an electromagnetic actuating unit for a hydraulic directional control valve, comprising the following steps:

a, assembling a yoke unit, an armature unit, a pole core unit and a coil with at least one of two bearing points being floatingly mounted in the yoke unit or in the pole core unit;

b. coaxially aligning of the two bearing points with at least one of the two bearing points being radially movable While the two bearing points are being aligned; and c. fixing the bearing point, which is floatingly mounted, wherein the coaxially aligning of the bearing points takes place by insertion of the yoke unit and of the pole core unit into a centering sleeve arranged in an interior of the coil.

8. The method as claimed in claim 7, wherein the fixing of the bearing point which is floatingly mounted takes place by pressing-in, adhesive bonding, soldering, welding, crimping or clamping or a combination of the connecting techniques.

9. The method as claimed in claim 8, wherein the fixing of the bearing point which is floatingly mounted takes place by adhesively bonding the coil into the pole core unit and adhesively bonding the yoke unit to the coil.

10. The method as claimed in claim 8, wherein the fixing of the bearing point which is floatingly mounted takes place by adhesively bonding or soldering or welding the yoke unit to the pole core unit.

11. The method as claimed in claim 8, wherein the fixing of the bearing point which is floatingly mounted takes place by adhesively bonding or soldering or welding the pole core to the magnet housing.

* * * * *